United States Patent [19]

Hamburg et al.

[11] 4,205,525

[45] Jun. 3, 1980

[54] TURBINE ENGINE LUBRICATION SYSTEM

[75] Inventors: Glenn Hamburg, Grosse Point, Mich.; Gytis Jasas, Toledo, Ohio; John Monarch, deceased, late of Toledo, Ohio, by Janet H. Monarch, administratrix

[73] Assignee: Teledyne Industries, Inc., Los Angeles, Calif.

[21] Appl. No.: 887,614

[22] Filed: Mar. 17, 1978

[51] Int. Cl.[2] ..... F02C 7/06

[52] U.S. Cl. ..... 60/39.08; 184/6.11

[58] Field of Search ..... 60/39.08; 184/6.11

[56] References Cited

U.S. PATENT DOCUMENTS

| | | | |
|---|---|---|---|
| 2,676,458 | 4/1954 | Hill | 60/39.08 |
| 2,784,551 | 3/1957 | Karlby et al. | 60/39.08 |
| 4,080,783 | 3/1978 | Hamburg et al. | 60/39.08 |

*Primary Examiner*—Louis J. Casaregola

*Attorney, Agent, or Firm*—Gifford, Van Ophem, Sheridan & Sprinkle

[57] ABSTRACT

A lubrication system for a turbine engine having a main shaft rotatably mounted by a bearing assembly in a support housing is provided in which the turbine fuel is used as the lubricant. The main turbine shaft rotatably drives a fuel pump having its inlet coupled to the fuel source for the turbine engine and having its outlet coupled to outlet passage means formed in the support housing. The passage means, in turn, is fluidly connected to a fuel jet orifice positioned in the support housing to project a high velocity and low flow fuel stream onto the bearing assembly and thereby lubricates and cools the same. After passing through the bearing assembly, the fuel lubricant exhausts through exhaust passage means formed between the turbine and the support housing and is exhausted into the exhaust duct of the turbine engine.

8 Claims, 1 Drawing Figure

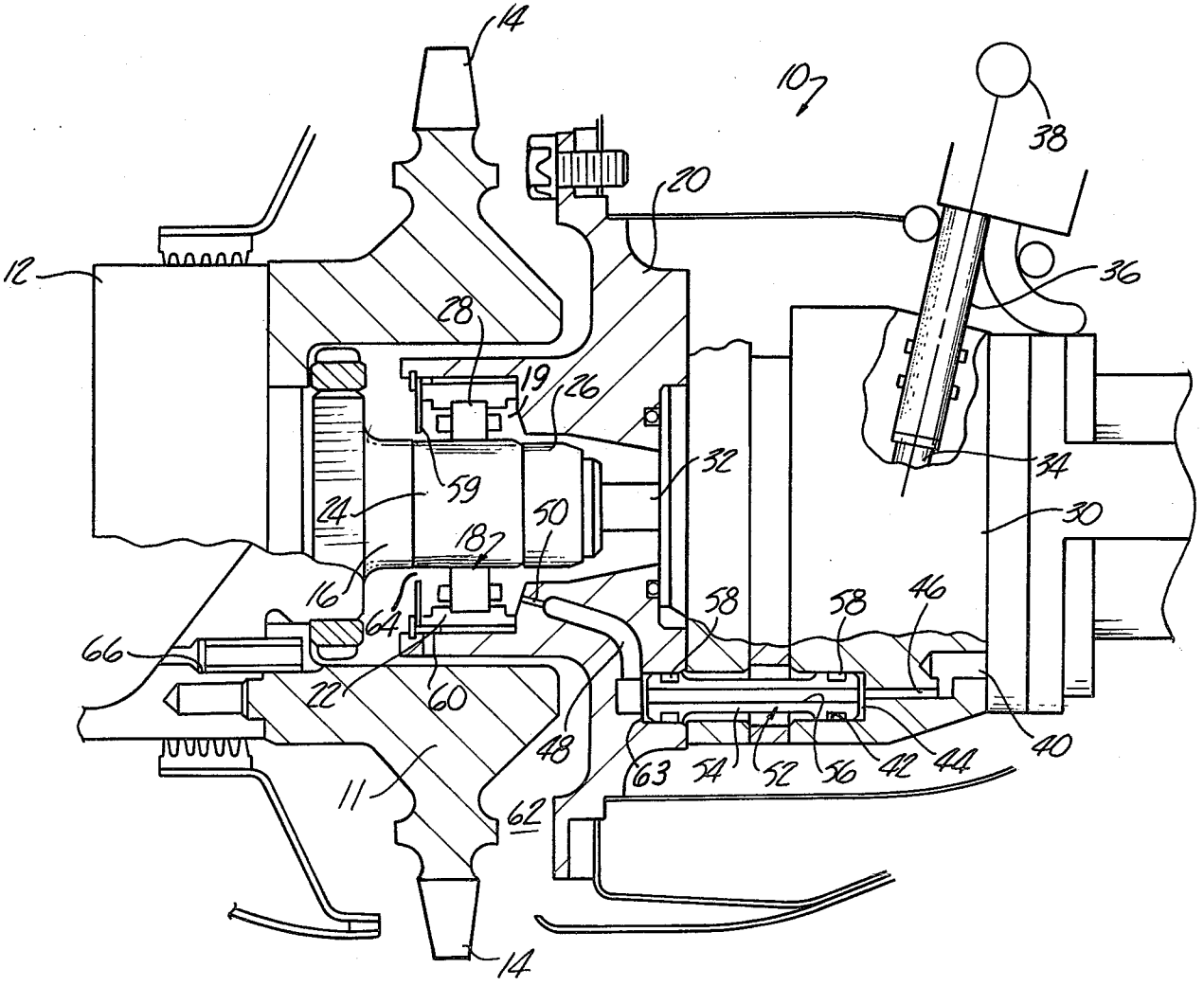
10
12
14
14
16
18
19
20
22
24
26
28
30
32
34
36
38
40
42
44
46
48
50
52
54
56
58
58
59
60
62
63
64
66

TURBINE ENGINE LUBRICATION SYSTEM

BACKGROUND OF THE INVENTION

I. Field of the Invention

The present invention relates generally to turbine engine lubrication systems and, more particularly, to such a system which utilizes the turbine engine fuel as the lubricant.

II. Description of the Prior Art

Gas turbine engines typically include a main shaft rotatably supported by a bearing assembly in a support housing which is stationary relative to the main shaft. The main shaft rotates at high rotational speeds thus requiring that the bearing assembly be constantly and adequately lubricated. Without adequate lubrication, the bearing assembly can seize or otherwise fail which renders the turbine engine inoperable and may even result in the destruction of the turbine engine.

There have been many previously-known turbine engine lubrication systems which employ a high-grade oil as the lubricant. While these previously-known lubrication systems vary in precise construction between each other, typically an oil pump, situated within the support housing, continuously pumps oil to the bearing assembly by one or more jets which direct the oil into the bearing assembly, or by radial ports formed in one or both of the bearing races of the bearing assembly. These previously-known oil pumps can be electrically, pneumatically or hydraulically powered, but typically are rotatably driven by a gear arrangement mechanically coupled to the main shaft of the turbine engine. After passing through the bearing assembly, the oil is collected in a reservoir formed in the bottom of the bearing cavity and is subsequently cooled, filtered, and recirculated through the bearing assembly by the oil pump.

These previously-known turbine engine lubrication systems, however, are disadvantageous for a number of reasons. First, the previously-known turbine lubrication systems are expensive in construction due not only to the cost of the oil pump, but also in the cost of the associated oil reconditioning systems, and the means for driving the oil pump. In addition, the oil pumps and their associated components are bulky and heavy in construction and thus present a design problem for the turbine engine.

A still further disadvantage of these previously-known turbine lubrication systems is that such systems, and particularly the oil pump, are prone to failure. Upon such failure, of course, the oil is no longer pumped to the bearing assembly so that the bearings rapidly heat up and fail. As previously mentioned, the failure of the bearing assembly can result in the destruction of the turbine engine.

A still further disadvantage of these previously-known turbine lubrication systems is that the oil is collected in a reservoir formed in the bearing cavity for recirculation by the oil pump through the bearing assembly. Collection or accumulation reservoirs must be provided to accommodate any orientation of the turbine engine with respect to the vertical. In order to ensure that the oil can be returned to the pump for recycling each additional accumulation reservoir requires a separate pump element to return the oil to the pump or main storage reservoir and the additional expense and complexity adversely affects both the cost and the reliability of the overall lubrication system.

SUMMARY OF THE PRESENT INVENTION

The turbine engine lubrication system of the present invention overcomes these above-mentioned disadvantages of these previously-known lubrication systems by providing a lubrication system which utilizes the engine fuel as the lubricant.

In brief, the lubrication system of the present invention employs a fuel pump mounted coaxially with the main shaft and rotatably driven by a connecting shaft. The fuel pump includes an inlet coupled to the fuel supply of the turbine engine and an outlet fluidly coupled to the fuel supply system of the turbine engine. In addition, however, a lubrication passage is formed through the bearing support housing which is fluidly coupled at one end to the fuel pump outlet and at its other end to a fuel jet orifice positioned within the support housing to direct a fuel stream onto the bearing assembly. A simple metering device in the lubrication passage limits the fuel supply to the fuel jet orifice so that the fuel jet orifice projects a relatively high velocity and low flow fuel stream onto the bearing assembly.

The fuel stream from the fuel jet orifice impinges upon, lubricates, and cools the bearing assembly. The fuel furthermore passes through the bearing assembly and is exhausted into the exhaust duct of the turbine engine. Moreover, while the lubrication system according to the present invention does consume a portion of the engine fuel during the lubrication process, the portion so consumed is insignificant and does not adversely deplete the fuel supply to the engine.

The lubrication system of the present invention thus achieves several advantages over the previously-known turbine lubrication systems. First, by utilizing the main fuel pump to supply the fuel to the bearing assembly, the previously-known oil pumps and their associated components are entirely eliminated along with their cost, weight and bulk.

A still further advantage of the present invention is that the lubricant, i.e., the engine fuel, is not recirculated, but rather exhausted from the turbine engine after use. This provision eliminates the need for any lubricant conditioning equipment, such as filters, coolers, and deaerators, and also eliminates the need to collect the lubricant in a reservoir for recirculation so that the orientation of the turbine engine during operation does not adversely effect the lubrication system of the present invention.

BRIEF DESCRIPTION OF THE DRAWING

A better understanding of the present invention will be had upon reference to the following detailed description when read in conjunction with the accompanying drawing which is a fragmentary, partial cross-sectional view illustrating a turbine engine employing the lubrication system according to the present invention.

DETAILED DESCRIPTION OF THE PRESENT INVENTION

With reference to the drawing, a portion of the turbine engine 10 is thereshown and comprises a main turbine shaft 12 having a disc 11 and a plurality of turbine blades 14 (only two of which are shown) secured thereto. The main turbine shaft 12 further includes a threaded shaft extension 16 of reduced diameter which is rotatably journaled by means of a bearing assembly 18 contained in a bearing cavity 19 in a support housing 20.

Although the bearing assembly 18 may be of any conventional construction, as shown, it includes an annular outer race 22 secured to the support housing 20 and an inner race 24 secured to the threaded shaft extension 16 by means of a nut 26. A plurality of bearing elements 28, such as rollers, are disposed between the outer race 22 and inner race 24 so that the main shaft 12 can rotate via the bearing assembly 18 relative to the support housing 20.

A fuel pump 30 is secured to and carried by the support housing 20 coaxially and rearwardly of the shaft extension 16. The fuel pump 30 is preferably rotatably driven by means of a quill shaft 32 which is mechanically coupled to both the shaft extension 16 and the fuel pump 30. Consequently, rotation of the main shaft 12 rotatably drives and powers the fuel pump 30.

The fuel pump 30 includes both an inlet 34 coupled by fluid conduit means 36 to a fuel supply 38 of the turbine engine 10 and a pump outlet 40 into which pressurized fuel is supplied by the pump 30. The pump outlet 40 is connected by fuel passage means (not shown) to the fuel system of the turbine engine 10 in any conventional fashion.

An elongated cylindrical chamber 42 is formed within the fuel pump housing and coupled at one axial end 44 by a passage 46 to the pump outlet 40. The chamber 42 is connected by means of a metering device 52 to a cylindrical chamber 63 in the support housing 20 which in turn is coupled by another passage 48 to a fuel jet orifice 50 which is open to the bearing cavity 19. The fuel jet orifice 50 has a restricted cross-sectional area and is positioned within the support housing 20 to direct fluid flow onto the bearing assembly 18.

A metering device 52 is contained within the chambers 42 and 63 and functions to regulate and limit the fuel flow from the passage 46 to the passage 48. While the metering device 52 may be of any conventional type, preferably it comprises an elongated cylinder 54 contained within the chamber 42 and having an axial throughbore 56 of a predetermined cross-sectional area. One end of the throughbore 56 is open to the passage 46 whereas the other end of the throughbore 56 is open to the passage 48 so that the throughbore 56 permits fluid communication from the pump outlet 40 to the fuel jet orifice 50. The cross-sectional area of the throughbore 56 is restricted which limits the maximum flow rate through the metering device 52. Additionally, annular sealing means 58 between the device 52 and the support housing 20 as well as the fuel pump housing, prevents fluid flow around the outer periphery of the metering device 52.

An annular bearing shield 59, preferably constructed from sheet metal, is provided adjacent the bearing assembly 18 in the bearing cavity 19 on the side opposite from the fuel jet orifice 50 for a reason to be shortly described. In addition, an annular opening 60 between the support housing 20 and the rotating turbine disc 11 permits fluid communication from the bearing cavity 19 to a passage 62 which is open to the exhaust duct of the turbine engine 10.

In operation, rotation of the main shaft 12 rotatably drives the fuel pump 30 via the quill shaft 32 in the previously described fashion. Rotation of the fuel pump 30 supplies pressurized fluid at the pump outlet 40 which is fed to the fuel supply system of the turbine engine 10 by the appropriate passage means, not shown.

A relatively small portion of the engine fuel is fed through passage 46, the metering device 52, and the passage 48 to the fuel jet orifice 50 which injects this portion of the fuel onto the bearing assembly 18. The metering device 52 limits the maximum fuel flow to the orifice 50 so that a high velocity and yet low flow rate fuel jet impinges upon the bearing assembly 18. The fuel jet upon the bearing assembly 18 both cools and lubricates the bearing assembly 18.

The shield 59 protects the bearing assembly 18 from contaminants from the turbine, but is dimensioned so that a narrow annular opening 64 is present between the shield 59 and the bearing inner race 24. The fuel from the orifice 50, after lubricating and cooling the bearing assembly 18, exhausts through this annular opening 64 so that the constant fuel flow through the annular opening 64 further prevents contaminants from entering into the bearing cavity 19 around the shield.

Thereafter the fuel is exhausted through the annular opening 60 and exhaust passage 62 and to the exhaust duct of turbine engine 10 in which the fuel lubricant is consumed. However, during the exhaustion of the still relatively cool fuel through the annular opening 60, the fuel contacts and removes heat from the portion of the support housing 20 positioned radially outwardly from the bearing outer race 22. This, provides additional cooling of the bearing assembly 18.

In order to ensure against fires in the discharge circuit 64, 60, and 62 due to the presence of fuel, compressed air from the turbine engine is supplied through ports 66 to the annular cavity 60. This compressed air mixes with the fuel and the resultant mixture exhausts through the annular opening 60 and exhaust passageway 62. The compressed air dilutes the fuel concentration sufficiently so that the resultant fuel-air mixture is below its flammability range, and effectively prevents fires in the passageways 64, 60, and 62 as might otherwise occur.

From the foregoing, it can be seen that the turbine engine lubrication system of the present invention provides a simple and yet effective means for bearing lubricaton which is virtually fail-safe in operation. Moreover, by using the engine fuel as the lubricant, the high cost of the previously-known oil lubricaton systems is significantly reduced and a more reliable lubrication system is obtained.

The turbine engine lubrication system of the present invention is furthermore advantageous over the previously-known systems in that the lubricant, i.e., the fuel, is exhausted from the engine after use rather than recycled as in the previously-known lubrication systems. Consequently, the turbine engine can assume any orientation for any period of time without fear of emptying or evacuating the previously-known lubricant reservoirs necessary in recirculation systems.

Having thus described our invention, many modifications thereto will become apparent to those skilled in the art to which it pertains without deviation from the spirit of the invention as described by the scope of the appended claims.

We claim:

1. A lubrication system for a turbine engine having a main shaft rotatably mounted by bearing means contained in a bearing cavity in a support housing, and an engine exhaust duct adjacent said bearing cavity, said lubrication system comprising:

a fuel pump having an inlet and an outlet, the inlet of said pump being connected to a fuel supply for the turbine engine and adapted to deliver only fuel to the outlet;

passage means formed in said support housing for providing fluid communication from said pump outlet to said bearing cavity so that fuel flow from said pump outlet through said passage means impinges upon said bearing means; and means for exhausting the fuel from said bearing cavity comprising an open passageway axially adjacent said bearing means and in fluid communication with said bearing cavity and said engine exhaust duct.

2. The invention as defined in claim 1 and including metering means disposed in said passage means for limiting the fuel flow rate through said passage means.

3. The invention as defined in claim 2 wherein said metering means comprises a member disposed in said passage means and having a bore formed therethrough of a predetermined cross-sectional area.

4. The invention as defined in claim 1 wherein said fuel pump is mounted in said support housing coaxially with said main shaft and rotatably driven by a shaft coaxially coupled with said main shaft.

5. The invention as defined in claim 1 wherein said passage means includes a restricted orifice at the bearing cavity.

6. The invention as defined in claim 1 wherein a portion of said support housing is disposed annularly around said bearing means and wherein a portion of said exhaust passage is disposed around said housing portion so that fuel flow through said exhaust passage contacts and cools said housing portion and thereby cools said bearing means.

7. The invention as defined in claim 1 and further comprising a source of pressurized air coupled to said exhaust passage which dilutes the fuel concentration in said exhaust passage to thereby prevent combustion of the fuel in the said exhaust passage.

8. The invention as defined in claim 1 wherein said passage means communicates with the bearing cavity on one axial end of the bearing means and including an annular shield disposed between the support housing and the main shaft on the other axial end of said bearing means, said shield being spaced radially outwardly from said shaft to form an annular opening between said shield and said shaft to permit fluid flow through said annular opening.

* * * * *